US009554205B2

(12) United States Patent
Urup et al.

(10) Patent No.: US 9,554,205 B2
(45) Date of Patent: Jan. 24, 2017

(54) FITTING SYSTEM FOR A HEADPHONE WITH PHYSIOLOGICAL SENSOR

(71) Applicant: GN Netcom A/S, Ballerup (DK)

(72) Inventors: Kathrine Steen Urup, Vaerlose (DK); Lars Bohn Hansen, Holte (DK)

(73) Assignee: GN Netcom A/S (DK)

( * ) Notice: Subject to any disclaimer, the term of this patent is extended or adjusted under 35 U.S.C. 154(b) by 21 days.

(21) Appl. No.: 14/571,471

(22) Filed: Dec. 16, 2014

(65) Prior Publication Data

US 2015/0181325 A1 Jun. 25, 2015

(30) Foreign Application Priority Data

Dec. 20, 2013 (EP) ..... 13198727

(51) Int. Cl.
*H04R 1/10* (2006.01)
*H04R 29/00* (2006.01)

(52) U.S. Cl.
CPC ..... *H04R 1/1091* (2013.01); *H04R 1/10* (2013.01); *H04R 1/1041* (2013.01); *H04R 29/001* (2013.01)

(58) Field of Classification Search
CPC ..... H04R 5/033; H04R 1/1041; H04R 1/1091; H04R 1/10; H04R 29/001
USPC ..... 381/74
See application file for complete search history.

(56) References Cited

U.S. PATENT DOCUMENTS

2008/0146890 A1* 6/2008 LeBoeuf ..... A61B 5/0059 600/300
2009/0150919 A1* 6/2009 Lee ..... H04N 7/17309 725/10
2010/0217098 A1* 8/2010 LeBoeuf ..... A61B 5/00 600/301
2013/0083933 A1* 4/2013 Aase ..... H04R 1/1041 381/58
2013/0121494 A1* 5/2013 Johnston ..... H04R 1/1041 381/56
2014/0257813 A1* 9/2014 Mortensen ..... G10L 15/02 704/251

OTHER PUBLICATIONS

Extended European Search Report dated Jun. 12, 2014 for European application No. 13198727.3.

* cited by examiner

*Primary Examiner* — Simon King
(74) *Attorney, Agent, or Firm* — Altera Law Group, LLC

(57) ABSTRACT

A headphone system comprising a physiological sensor and a method of fitting a headphone system comprising a physiological sensor to a user is provided. The headphone system comprises a headphone having a speaker, a physiological sensor configured to be positioned for measuring physiological data, and a processor connected to the physiological sensor to receive the measured physiological data and process the measured physiological data to output physiological information and a fitting parameter. An application program is associated with the headphone, and is configured to receive the physiological information and the fitting parameter. The application program may evaluate at least the fitting parameter to indicate to a user whether the headphone is properly positioned, and issue a first notification in dependence on the evaluation of the fitting parameter.

17 Claims, 7 Drawing Sheets

FITTING SYSTEM FOR A HEADPHONE WITH PHYSIOLOGICAL SENSOR

TECHNICAL FIELD

The present invention relates to headphones, such as to headsets or headphones, having a physiological sensor, and in particular to headphone(s) or headset systems including an evaluation of the fitting of the headphones or headsets when positioned in the ear of a user.

BACKGROUND

It is known in the art to provide real-time, noninvasive health monitors or sensors in an earpiece. The health monitors may include a plurality of compact sensors integrated within devices small enough to fit into the ear. Physiological data is collected and these data may be transmitted into a processor, where the data is stored and/or processed. It is suggested to provide an ear piece of a set of headphones with sensors, and the headphone or the earpiece may communicate with the processor either using a wired connection or using any known wireless protocol, such as Bluetooth, Wi-Fi, or ZigBee.

The processor then processes and organizes the data into charts and display these on e.g. a mobile phone or a computer to convey the information extracted from the measured data to the user.

However, it may be a challenge to obtain reliable data from the sensors.

SUMMARY

It is an object of the present invention to improve the data quality of data acquired from the sensors in the earpiece.

According to one aspect of the present disclosure, a headphone system is provided, the headphone system comprising a headphone having a speaker, a physiological sensor configured to be positioned for measuring physiological data, and a processor connected to the physiological sensor to receive the measured physiological data and process the measured physiological data to output physiological information and a fitting parameter. The headphone system further comprises an application program associated with the headphone, the application program being configured to receive the physiological information and the fitting parameter. The application program may evaluate at least the fitting parameter to indicate to a user whether the headphone is properly positioned, and issue a first notification in dependence on the evaluation of the fitting parameter.

According to another aspect of the present disclosure, a method of fitting a headphone system comprising a physiological sensor to a user is provided. The headphone system comprises a headphone having a speaker, a physiological sensor configured to be positioned for measuring physiological data of the user and a processor connected to the physiological sensor to process physiological data and outputting physiological information and a fitting parameter. The method comprises the steps of receiving the physiological information and the fitting parameter in an application program associated with the headphone, evaluating the fitting parameter, and issuing a first notification, for example via a computer application user interface, in dependence of the evaluation of the fitting parameter.

The headphone has a speaker and a physiological sensor configured to be positioned for measuring physiological data. The physiological sensor may for example be configured to be positioned in or near the ear of a user, such that when the headphone is positioned in its operational position at the ear of a user, the physiological sensor is positioned to allow for measuring of physiological data from the user. In some embodiments, the physiological sensor may be attached to the ear. Alternatively, or additionally, the physiological sensor may form part of the headphone.

The headphone may be any headphone or set of headphones, a headset, such as an over-the-ear headset or an in-the ear headset and the headphone, the set of headphones and/or the headset may be worn by a user in any conventional way, including using a headband, a neckband, an ear clip, an ear hook, a press fit, etc.

The sensor may be any sensor capable of measuring physiological data, such as any transducer or electrode. The sensor may be a touch-free sensor capable of touch-free measuring of physiological data. The sensor may be an optical sensor, a pressure sensitive sensor, an electrode, a movement sensor, such as an accelerometer, a position sensor, a capacitive sensor, etc.

In some embodiments, the sensor is provided in the ear of a user. The sensor may thus form part of an ear piece, such as an ear bud of an in the ear headphone or just outside the inner ear on the headphone, or the sensor may be provided in an ear plug or ear bud connected to an over the ear headphone.

The ear piece with sensors may form part of a headphone, and the headphone or the ear piece may communicate with the processor either using a wired connection or using any known wireless protocol, such as Bluetooth, DECT, Wi-Fi, or ZigBee.

The headphone furthermore comprises a processor connected to the physiological sensor to receive the measured physiological data and process the measured physiological data to output physiological information and a fitting parameter.

The physiological data may be any data measured from the sensor, and the processor may be configured to process the physiological data to provide physiological information, such as heart rate, distance travelled, metabolic rate, calories burned, $VO_2$ max and many others.

The fitting parameter may provide an indication of the positioning of the sensor in or at the ear when the headphone is worn in its intended operational position by a user. The fitting parameter may thus indicate the quality of the sensor data received by the processor and/or the fitting parameter may indicate how well the sensor is positioned in order for the sensor to measure physiological data from the user. By providing the fitting parameter to the application program, an indication of the fit of the headphone is provided, that is an indication of how well the placement or positioning of the sensor is in order for the sensor to receive high quality sensor data.

The fitting parameter may for example be a value, and the value of the fitting parameter may indicate whether the sensor has a fit which is sufficient for the sensor to receive the sensor data in a well defined quality or whether the user should adjust the headphone and/or the sensor with respect to the ear to improve the fitting parameter, and thus improve the quality of data received from the sensor.

It is an advantage of the present invention that a fitting parameter is provided to the application program in order for the user to obtain an objective measurement of the fit of the headphone. Typically, the fitting has been a subjective opinion of the user of whether the fitting of the headphone is perceived as good.

The application program may evaluate at least the fitting parameter to indicate to a user whether the headphone is properly positioned. The application program may furthermore issue a first notification in dependence on the evaluation of the fitting parameter. The application program may be any application program, such as an app, and may be executable on external device, such as an external device comprising a processor.

The first notification may be affirmative or negative in dependence on the fitting parameter. In some embodiments, the evaluation of the fitting parameter includes comparing the received fitting parameter to a fitting parameter threshold to indicate proper positioning or improper positioning of the headphone. A first affirmative notification may be issued if the headphone is properly positioned and a first negative notification may be issued if the headphone is improperly positioned.

The fitting parameter may be a measure of the quality of the measured physiological data. The fitting parameter threshold may be a quality parameter, such that for fitting parameter values above the fitting parameter threshold, the headphone is correctly positioned with respect to the sensor, and an affirmative notification may be issued, and likewise, for fitting parameter values below the fitting parameter threshold, a negative notification may be issued, or vice versa in dependence on the selected fitting parameter.

A first affirmative notification may be issued if the headphone is properly positioned to e.g. inform the user that the headphone and/or the sensor is correctly positioned. The headphone and/or sensor may be correctly positioned when it is positioned in such a way that the sensor receives sufficiently good signals from the user and thus that the data quality of the physiological data received in the processor are sufficiently good so that a user may for example start an exercise. Likewise, a first negative notification may be issued if the headphone is improperly positioned. A first negative notification may thus prompt the user to adjust the headphone and/or the sensor to improve the positioning of the sensor, e.g. before starting an exercise.

The headphone system, such as the application program may comprise a fitting test mode to assist a user adjusting the headphone and/or the sensor to improve the quality of the physiological data received from the sensor. The fitting test mode may be activated manually or automatically, for example upon issuing of the first negative notification. Thus, a user who receives a negative notification may select the fitting test mode, or the issuance of a negative notification may activate the fitting test mode.

The fitting test mode may for example comprise a quick start fitting test to give the user an option to check if the headphone and/or the sensor is positioned correctly in or at the ear for the processor to be able to receive sufficiently good physiological data to enable providing of reliable physiological information to the application program before starting use of the headphone system, such as before starting an exercise. The test mode, such as the quick start fitting test, may provide a graphical visualization on how the headphone should be fitted into the ear. The fitting parameter or an indication of the fitting parameter, such as a graphical illustration of the fitting parameter, may also be provided in the test mode to indicate to a user how well the placement or positioning of the sensor is.

The application program may provide a user interface, and the first notification may be issued via the user interface. The user interface may be an audio interface, a graphical interface, a multi media interface, a tactile interface, a display, etc. and any combination thereof. The first and any further notifications may be audio notifications and/or visible notifications issued via the user interface.

The fitting test mode may comprise a re-evaluation of the fitting parameter and the issuing of a further notification. The first and/or further notifications may include a suggestion to re-arrange the headphone comprising the physiological sensor. The fitting test mode may for example comprise feedback cycles for re-evaluation of the fitting parameter, such as after re-arrangement of the headphone and/or the sensor. Thus, for example, the user interface may display how the headphone and/or the sensor could be re-arranged to increase the quality of the physiological data. The display may include graphical explanations, multimedia elements, such as a video showing one or more possible corrections to the positioning of the headphone and/or the sensor.

The application program may upon issuing of a negative notification, re-evaluate the fitting parameter and issue a further notification in dependence of the fitting parameter.

The re-evaluation may be performed a predetermined period of time after issuing of a previous notification, thus providing the user with sufficient time to re-arrange or re-position the headphone and/or the sensor.

The user interface may comprise a visual user interface for issuing a visual notification. The user interface may additionally or alternatively comprise an audio user interface for issuing an audio notification, such as a sound, a voice speak, a musical element, etc. The visual or graphical user interface may be configured to graphically display a model of the ear of the user, the physiological sensor and/or the speaker as presently positioned in the ear of the user, the present positioning of the physiological sensor and/or the speaker being provided on basis of the received fitting parameter, and wherein the visual user interface is furthermore configured to suggest an adjusted positioning of the physiological sensor and/or the speaker to improve the quality of the measured physiological data.

The headphone may further comprise an exchangeable physiological sensor ear adaptor to ensure fitting of the sensor with the exchangeable physiological sensor ear adaptor to numerous different sizes, shapes and forms of ears. The application program may be configured to suggest exchange of the physiological sensor ear adaptor during fitting of the headphone, such as in the fitting test mode.

The speaker, i.e. the headphone speaker, may be configured to provide a test mode audio signal in or during the fitting test mode. The fitting test mode may comprise feedback cycles for re-evaluation of the fitting parameter, and the test mode audio signal may be a looped audio signal which is repeated for each feedback cycle. The application program may evaluate the test mode audio signal either automatically or via manual input from a user.

The application program may be any application program, and may be performed at a device external to the headphone system, such as performed at a dedicated headphone device, at a mobile phone, such as a smart phone, a personal digital assistant, a tablet computer, such as an iPad, a laptop, a computer, a health monitoring device, etc.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout. Like elements will, thus, not be described in detail with respect to the description of each figure.

DETAILED DESCRIPTION OF THE DRAWINGS

Figure 1:
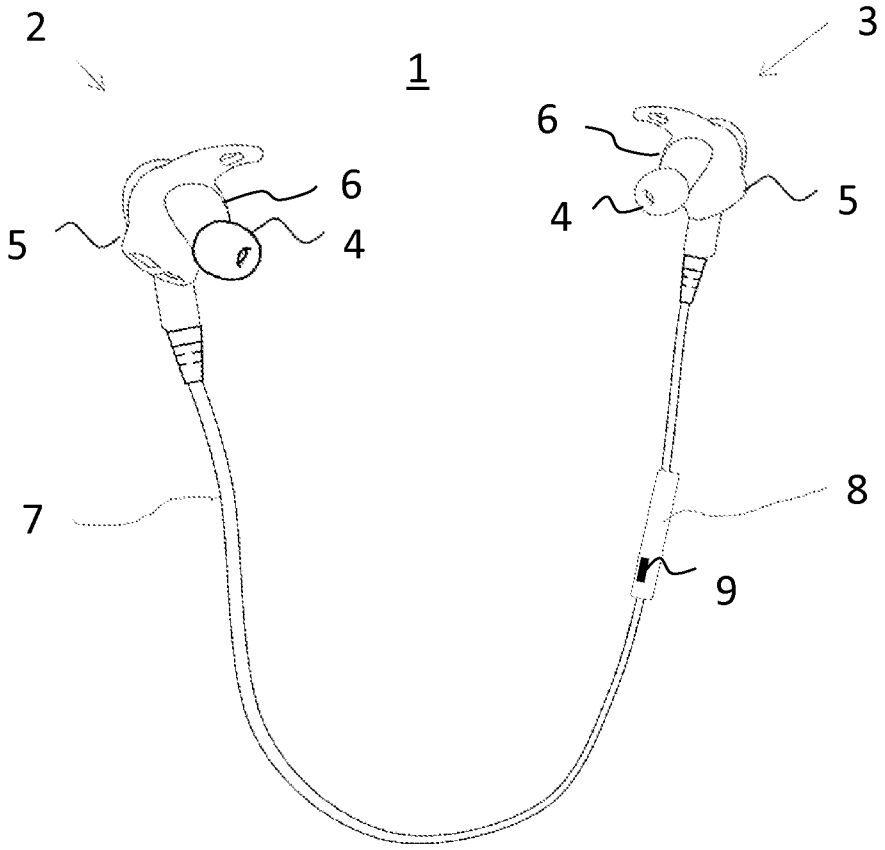
FIG. 1 shows a set of headphones.

In FIG. 1, a headset 1 is shown having a first headphone 2 and a second headphone 3. The headphones have an ear gel 4 and a fitting member 5. Each of the headphones 2, 3 comprises a speaker, a physiological sensor and a processor connected to the physiological sensor (not shown in FIG. 2) positioned in the main body 6. In some embodiments, only one of the headphones 2, 3 comprises a physiological sensor and a processor. A cord 7 interconnects the two headphones 2, 3 and a controller 8 is positioned on the cord. The headset may be a wireless headset, such as a Bluetooth headset, and may communicate wirelessly with for example a smart phone and/or a health monitoring device for example via Bluetooth. The controller comprises buttons for adjusting the volume, and a microphone 9. The fitting member 5 is positioned on the main body 6 to ensure a well-defined interface between the physiological sensor and the user when the headphone is positioned in the intended operational position in an ear of the user. In some embodiments, the fitting member 5 and the ear gel 4 may be a same member.

Figure 2:
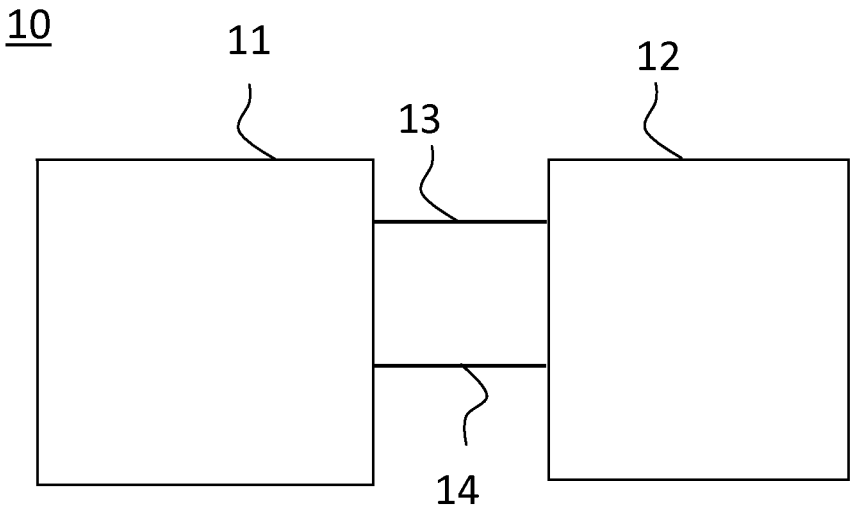
FIG. 2 shows a headphone system.

In FIG. 2, a headphone system 10 according to an embodiment of the present invention is shown. The headphone 11 is associated with application program 12. The application program 12 is configured to receive the physiological information and the fitting parameter from headphone 11 via input line 13. The application program evaluates at least the fitting parameter to indicate to a user whether the headphone is properly positioned, and issues a first notification in dependence on the evaluation of the fitting parameter for example via output line 14.

Figure 3:
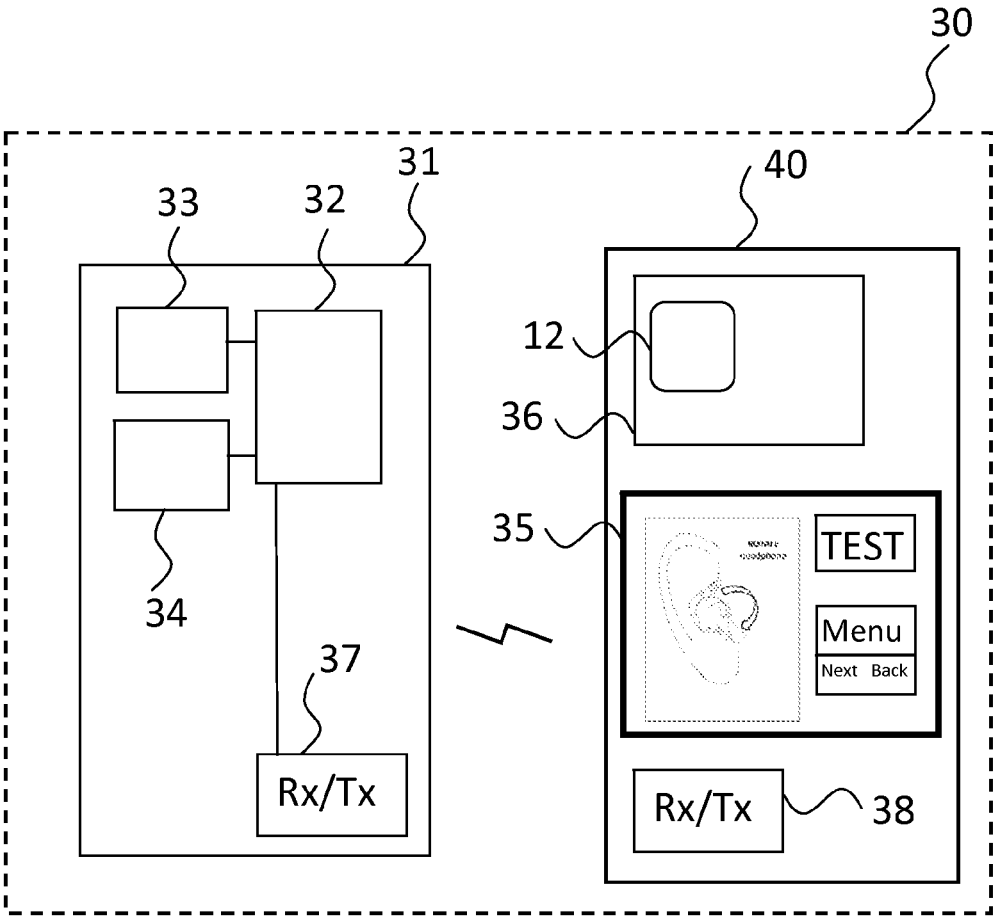
FIG. 3 shows a headphone system wherein the application program is run on a computing device.
Figure 4:
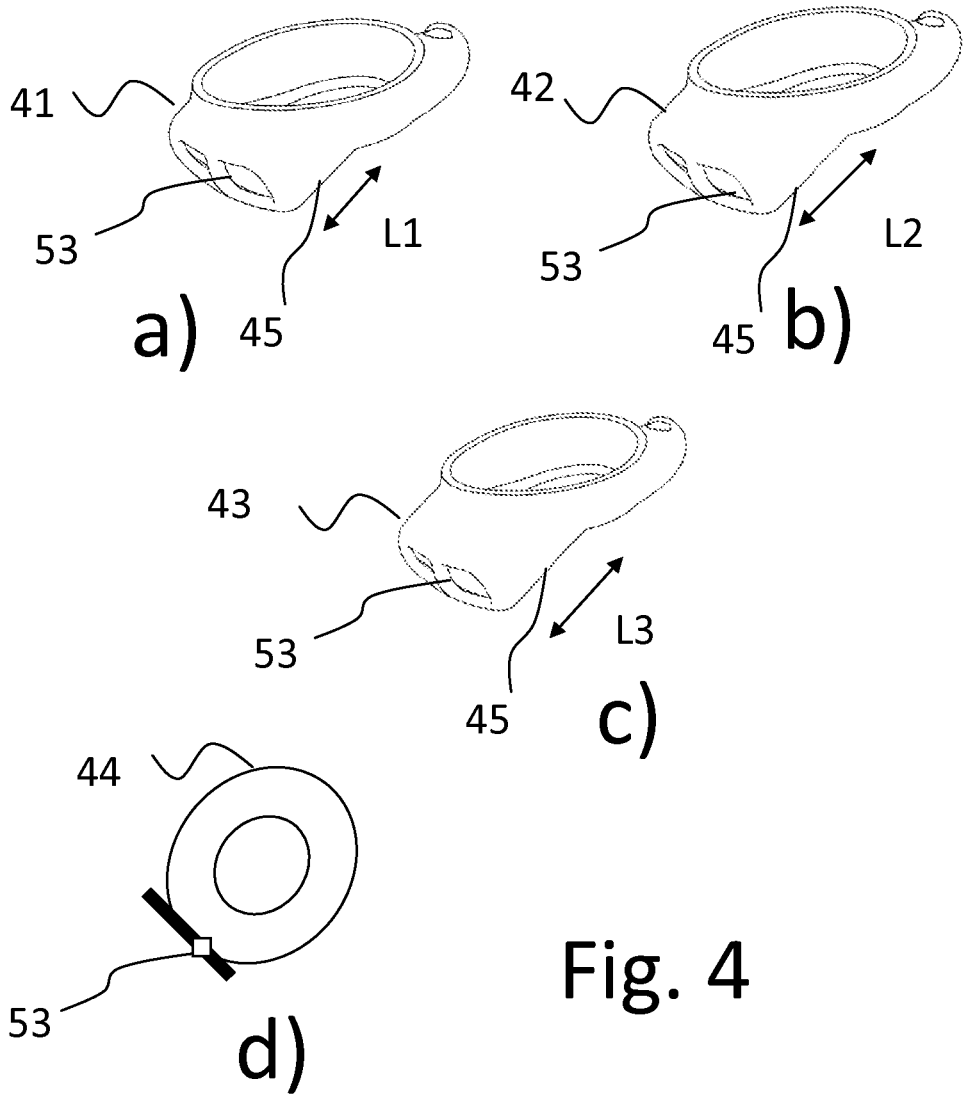
FIGS. 4*a-d* show different fitting elements.

FIG. 3 shows schematically a headphone system 30 comprising a headphone 31 and an application program 12 as run on a computing device 40. The headphone 31 comprises a processor 32, a speaker 33 and a physiological sensor 34. The headphone further comprises a wireless communications unit 37 for wirelessly communicating with the application program 12 when run on computing device 40. The computing device 40 comprises a wireless communication unit 38 for communicating with wireless communication unit 37 in the headphone. Computing device 40 furthermore comprises a processor 36 on which the application program 12 may be executed and a user interface 35, such as a user interface including a display. Computing device 40 may be a smart phone, a phablet, a tablet computer, a laptop, a handheld computer, a stationary computer, a personal digital assistant, a health monitor, such as a smart watch, running watch, etc.

The application program is configured to evaluate at least the fitting parameter to indicate to a user whether the headphone is properly positioned, and to issue a first notification in dependence on the evaluation of the fitting parameter. The notification may be provided via user interface 35, and may be a visual and/or audio notification. Additionally or alternatively, the notification may be provided to the user via the headphone, such as via the speaker in the headphone. The first notification may be affirmative or negative in dependence on the fitting parameter and the evaluation of the fitting parameter may include comparing the received fitting parameter to a fitting parameter threshold to indicate proper positioning or improper positioning of the headphone to a user. For example, the fitting parameter may be a fitting parameter having a value of between 1 and 100 in which 100 corresponds to optimal position of the sensor, i.e. 100%, and thus optimal signal reception. A value of for example 20 may be sufficient for the measurements to be reliable, thus the fitting parameter threshold may be 20, and the threshold may thus be 20%. If the headphone is properly positioned, a first affirmative notification is issued and if the headphone is improperly positioned, a first negative notification is issued.

In FIGS. 4*a-d*, different fitting elements 41, 42, 43, 44 are shown, the different fitting elements 41, 42, 43, 44 having different shapes and different sizes. For the physiological sensor to provide the best results, the fitting of the headphone and thus the fit of the fitting element 41, 42, 43, 44 in particular is of importance. The fitting elements 41, 42, 43, 44 have an opening for the sensor signals 53 which is provided in the lower part of the fitting element, configured to be positioned towards the lower part of an ear of a user. It is seen that the length of the part extending between the ear part (not shown), i.e. the sensor opening 53 and the sensor, 45, is smaller on fitting element 41 than on fitting element 42, thus L1 is smaller than the length L2, which again is smaller than the length L3 of the fitting element 43. Fitting element 44 has a different overall fitting shape, indicating that the fitting elements may have any shapes in order to fit the headphone to the ear of a user.

As all users have different ear shapes and sizes, typically, a selection of fitting element and ear gels are provided with a headphone, and typically, a user can select the ear gel and/or fitting element which feels most comfortably in the ear.

Figure 5:
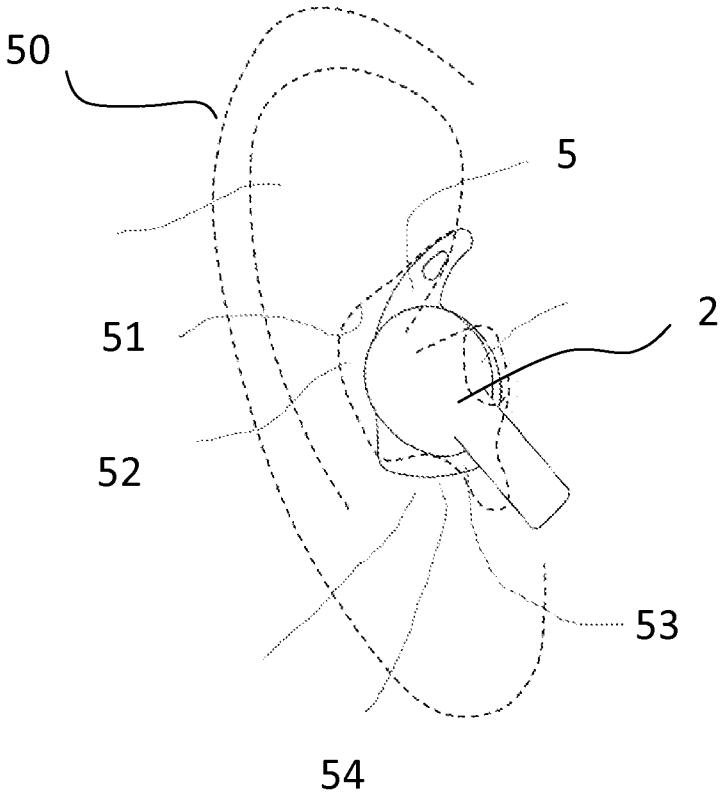
FIG. 5 shows a headphone as positioned in the ear of a user.

In FIG. 5, the headphone 2 is shown in the ear of a user 50. The headphone 2 is positioned in the concha 52 of the ear 50, and an upper part of the fitting element 5 presses against the upper wall 51 of the concha, whereas the sensor opening 53 is positioned against a lower wall 54 of the concha.

Figure 6A:
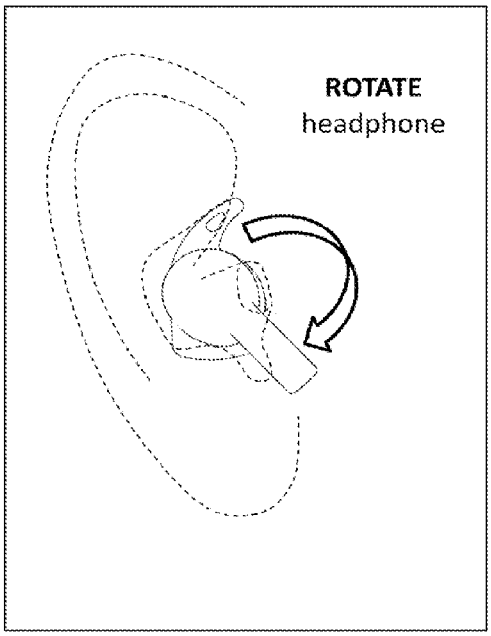
FIGS. 6*a-c* show fitting test mode displays.
Figure 6B:
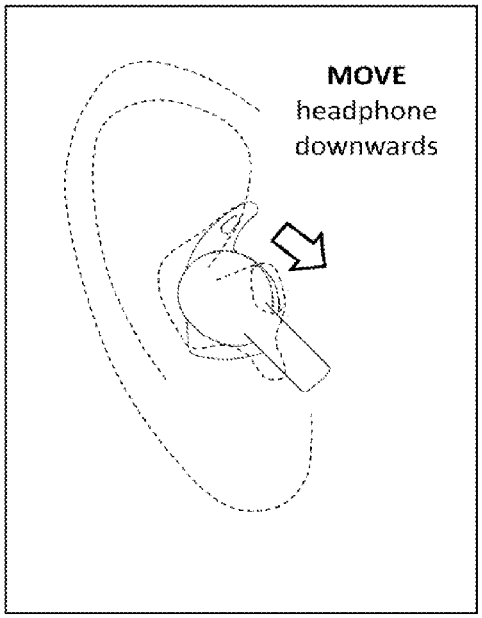
Figure 6C:
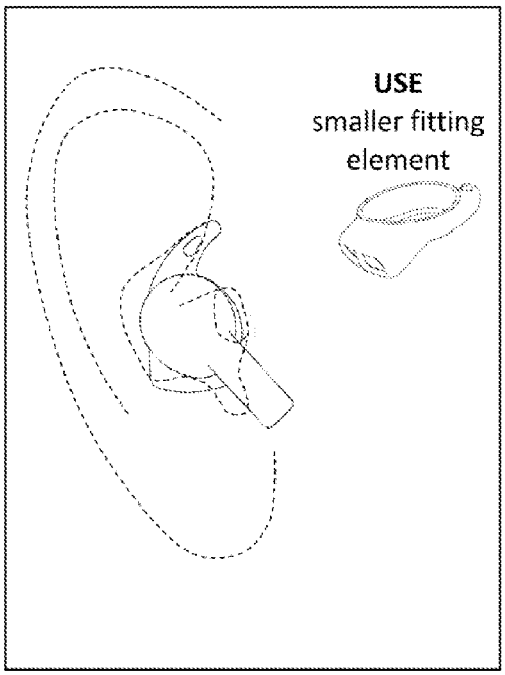

As mentioned above, the fitting parameter is a measure of the quality of the measured physiological data and the first notification is issued via a user interface to indicate to a user whether the headphone is properly positioned or not via either a first affirmative notification or a first negative notification. When the first notification has been provided, the headphone system may either automatically or via manual interaction from the user, enter a fitting test mode to improve the fitting of the headphone. The fitting test mode may be for example a wizard comprising a number of steps to assist the user in correctly fitting the headphone to the ear. FIGS. 6*a-c* show possible displays during the fitting test mode. It is envisaged that the fitting test mode may make use of any user interface means, such as to provide any multimedia feedback to the user, including displays, audio information, videos, etc., and any combination thereof.

The fitting test mode comprises a re-evaluation of the fitting parameter and the issuance of a further notification, and the first and/or further notification may include a suggestion to re-arrange the headphone comprising the physiological sensor. In FIGS. 6*a-c*, the user is asked to adjust the headphone and/or the fitting element to improve the sensor data quality. In FIG. 6*a*, the user is asked to rotate the headphone to improve the fitting; in FIG. 6*b*, the user is asked to move the headphone downwards; and in FIG. 6*c*, the user is asked to exchange the fitting element, and in this case asked to use a smaller fitting element to improve the quality of the sensor data.

After adjustment, the fitting parameter is re-evaluated and a further notification is provided, this loop may be continued till an acceptable level of sensor data is obtained.

Figure 7:
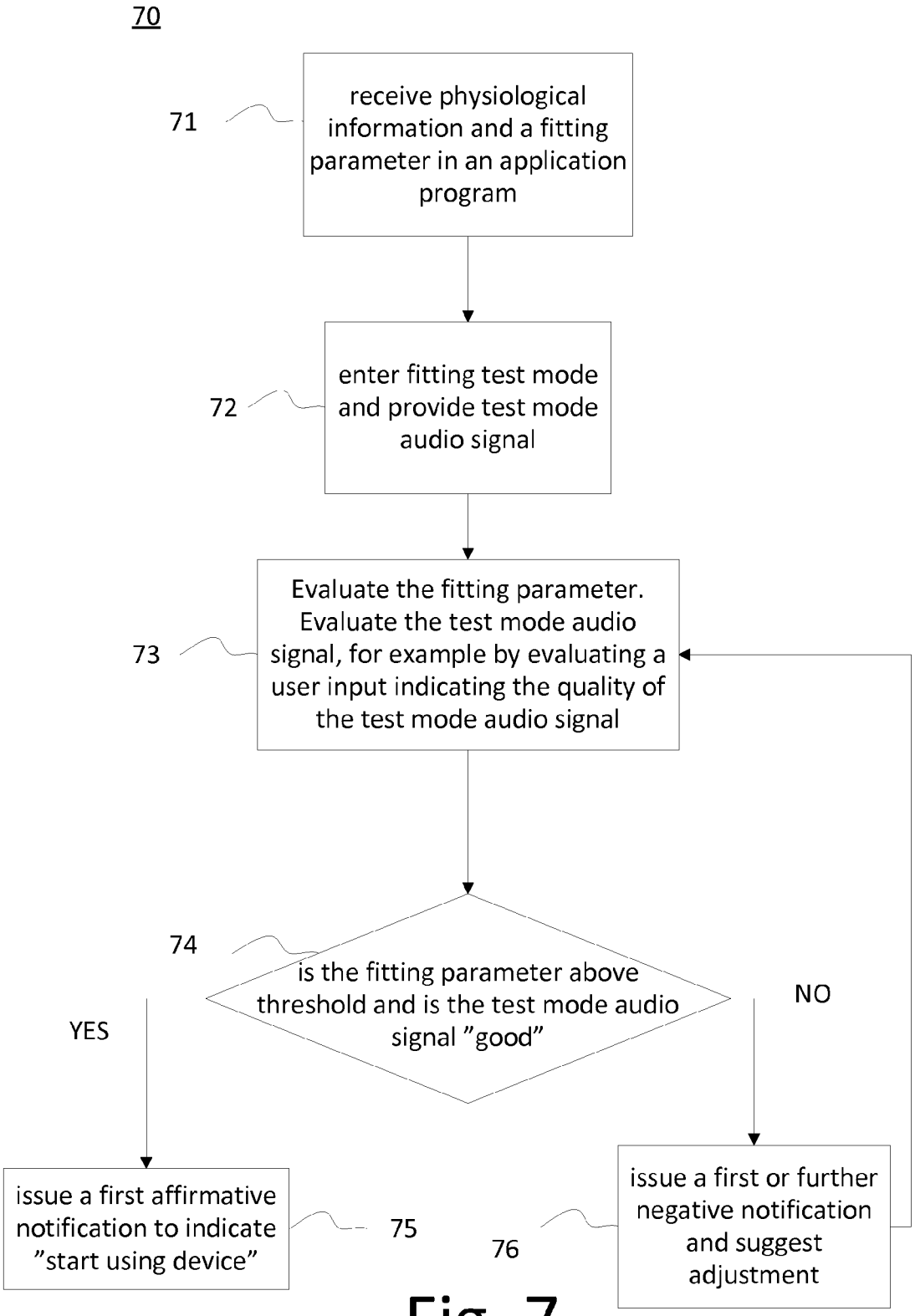
FIG. 7 is a flow chart showing a method of fitting.

FIG. 7 shows a flow chart describing a method 70 of fitting the headphone to a user. In step 71, physiological information and the fitting parameter is received in an application program, such as in a processor configured to run the application program. The application program is associated with the headphone. In step 72, a fitting test mode is entered. The fitting test mode may start up automatically, or the start up of the fitting test mode may be user initiated. During the fitting test mode, a test mode audio signal is provided. Step 73 is an evaluation step in which the fitting parameter is evaluated and is compared to a fitting parameter threshold. In step 73, also the test mode audio signal is evaluated. The test mode audio signal may for example be qualified by a user to be for example acceptable or "good", or unacceptable or "poor", however, a user may also indicate the quality of the test mode audio signal on a scale, and the quality may be interpreted as "good" if the quality is above a threshold quality level on the scale. In step 74, a decision is taken as to whether the fitting parameter is above the fitting parameter threshold and as to whether the test mode audio signal is "good". In the affirmative, an affirmative or positive notification is issued in step 75 so as to indicate to a user that the device is now well fitted and the user may start using the device. In case of a negative result, a first or further negative notification is issued in step 76 and the fitting is re-evaluated in step 73. The re-evaluation may follow after a certain time delay to allow for a user to have sufficient time to adjust or re-adjust the headphone. Furthermore, other criteria may be implemented, so as to enable finishing of the fitting in a reasonable number of steps. For example, the thresholds may be amended, and for example the threshold may be lowered after a certain number of steps to enable use of the system. Furthermore, one criterion may weigh stronger than another criterion, so that the use of the system may be initiated even if the audio quality is not sufficient after a certain number of re-evaluations.

Although particular embodiments of the present inventions have been shown and described, it will be understood that it is not intended to limit the claimed inventions to the preferred embodiments, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A headphone system comprising:

a headphone having a speaker, a physiological sensor configured to be positioned for measuring physiological data, and a processor connected to the physiological sensor to receive the measured physiological data and process the measured physiological data to output physiological information and a fitting parameter, an application program associated with the headphone, the application program being configured to receive the physiological information and the fitting parameter, wherein the application program evaluates at least the fitting parameter to indicate to a user whether the headphone is properly positioned to reliably detect physiological data from the user, and issues a first notification in dependence on the evaluation of the fitting parameter; and wherein the headphone system further includes a fitting test mode and wherein the fitting test mode includes feedback cycles for re-evaluation of the fitting parameter.

2. A headphone system according to claim 1, wherein the first notification is affirmative or negative in dependence on the fitting parameter.

3. A headphone system according to claim 2, wherein the application program upon issuing a negative notification, re-evaluates the fitting parameter and issue a further notification in dependence of the fitting parameter.

4. A headphone system according to claim 3, wherein the re-evaluation is performed a predetermined period of time after issuing of a previous notification.

5. A headphone system according to claim 1, wherein the evaluation of the fitting parameter includes comparing the received fitting parameter to a fitting parameter threshold to indicate proper positioning or improper positioning of the headphone to reliably detect physiological data from the user and issuing a first affirmative notification if the headphone is properly positioned and a first negative notification if the headphone is improperly positioned.

6. A headphone system according to claim 5, wherein the headphone system comprises a fitting test mode and wherein the fitting test mode is activated upon issuing of the first negative notification.

7. A headphone system according to claim 6, wherein the fitting test mode comprises a re-evaluation of the fitting parameter and the issuing of a further notification.

8. A headphone system according to claim 5, wherein the speaker is configured to provide a test mode audio signal in the fitting test mode.

9. A headphone system according to claim 8, wherein the test mode audio signal is a looped audio signal which is repeated for feedback cycles.

10. A headphone system according to claim 8, wherein the application program further evaluates the test mode audio signal.

11. A headphone system according to claim 1, wherein the fitting parameter is a measure of the quality of the measured physiological data.

12. A headphone system according to claim 1, wherein the application program is run on a device having a user interface, and wherein the first notification is issued via the user interface.

13. A headphone system according to claim 1, wherein the first and/or further notification includes a notification to the user to adjust the fit of the headphone comprising the physiological sensor.

14. A headphone system according to claim 1, wherein the application program is run on a device having a user interface, the user interface comprising a visual user interface for issuing a visual notification and/or the user interface comprising an audio user interface for issuing an audio notification and wherein the visual user interface is configured to graphically display a representation of a user's ear, the physiological sensor and/or the speaker as presently positioned in the ear of the user, the present positioning of the physiological sensor and/or the speaker being provided on basis of the received fitting parameter, and wherein the visual user interface is furthermore configured to suggest an adjusted positioning of the physiological sensor and/or the speaker to improve the quality of the measured physiological data.

15. A headphone system according to claim 1, wherein the headphone further comprises an exchangeable physiological sensor ear adaptor, and wherein the application program is configured to notify the user of the need to exchange of the physiological sensor ear adaptor during fitting of the headphone.

16. The headphone system of claim 1 wherein the physiological data is selected from the group of heart rate, distance travelled, metabolic rate, calories burned, or $VO_2$.

17. A method of fitting a headphone system comprising a physiological sensor to a user, the headphone system comprising a headphone having a speaker, a physiological sensor configured to be positioned for measuring physiological data of the user and a processor connected to the physiological sensor to process physiological data and outputting physiological information and a fitting parameter, the method comprising the steps of:

receiving the physiological information from a sensor in the headphone and the fitting parameter in an application program associated with the headphone, evaluating the fitting parameter, and issuing a first notification in dependence of the evaluation of the fitting parameter as to whether the physiological information is reliably received by the sensor; and further including a fitting test mode step and wherein the fitting test mode step includes feedback cycles for re-evaluation of the fitting parameter.

* * * * *